US008297176B2

(12) United States Patent
Buschow et al.

(10) Patent No.: US 8,297,176 B2
(45) Date of Patent: Oct. 30, 2012

(54) SEMIAUTOMATIC FIREARM HAVING LIGHTER COCKING ACTION

(76) Inventors: James M. Buschow, Texas City, TX (US); Martin Bryant, Texas City, TX (US)

( * ) Notice: Subject to any disclaimer, the term of this patent is extended or adjusted under 35 U.S.C. 154(b) by 60 days.

(21) Appl. No.: 13/032,815

(22) Filed: Feb. 23, 2011

(65) Prior Publication Data

US 2012/0167425 A1 Jul. 5, 2012

Related U.S. Application Data

(60) Provisional application No. 61/307,204, filed on Feb. 23, 2010.

(51) Int. Cl.
*F41A 3/46* (2006.01)

(52) U.S. Cl. ..... 89/196

(58) Field of Classification Search ..... 42/14, 16, 42/69.02; 89/194, 195, 196, 178
See application file for complete search history.

(56) References Cited

U.S. PATENT DOCUMENTS 4,972,760 A * 11/1990 McDonnell ..... 89/196
* cited by examiner

*Primary Examiner* — Daniel Troy
(74) *Attorney, Agent, or Firm* — The Matthews Firm

(57) ABSTRACT

An improved semiautomatic firearm is provided comprising as assembly which reduces the effort of cocking the firearm or loading a first cartridge. A spring tube contains an inner recoil spring which is employed only during cycling of the firearm when firing. For initial cocking purposes, the inner recoil spring is bypassed in favor of a lighter outer spring which is selectively engaged by the user. When the inner recoil spring is engaged, both inner and outer springs are employed without adversely affecting the recoil dynamics of the firearm.

8 Claims, 11 Drawing Sheets

SEMIAUTOMATIC FIREARM HAVING LIGHTER COCKING ACTION

CROSS-REFERENCE TO RELATED APPLICATIONS

This nonprovisional patent application claims priority under 35 U.S.C. §119 to U.S. Provisional Application Ser. No. 61/307,204, filed on Feb. 23, 2010.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON COMPACT DISC

Not applicable.

BACKGROUND OF THE INVENTION

1. Field of the Invention

The present invention relates to semiautomatic firearms, and particularly to such firearms having a lighter cocking action and less felt recoil.

2. Description of Related Art

Semi-automatic pistols commonly include a slide normally biased in a forward position on the frame, but movable rearwardly of the frame by the recoil produced by a fired cartridge. A recoil spring is coupled to the slide and is compressed as the slide moves rearwardly of the frame. As the slide clears the magazine below and reaches the slide stop, the recoil spring urges the slide back to its original position and loads another cartridge from the magazine into the chamber. Such pistols are initially loaded by inserting a magazine of cartridges into the butt of the pistol, and then manually drawing the slide back against the action of the recoil spring, and then releasing it, to load the first cartridge into the firing chamber and to cock the hammer. After each firing of a cartridge, the pistol thereafter utilizes the recoil produced by the firing of that cartridge to cock the pistol for the next cartridge, and introduce a new cartridge into the chamber.

Manually pulling back the slide to load the first cartridge requires a substantial manual effort, typically in excess of 5-10 pounds of force. Such a large manual force may be difficult to apply for certain persons without the required strength to operate the pistol, particularly by some women or older persons. Moreover, this large manual force to initially load the pistol may limit the strength of the recoil spring that may be used, and thereby the recoil action absorbed by the recoil spring.

Over the years, a number of devices have been developed in connection with semiautomatic firearms to either reduce the cocking effort or felt recoil when firing, including U.S. Pat. No. 4,173,169 to Yates; U.S. Pat. No. 4,201,113 to Seecamp; U.S. Pat. No. 4,344,352 to Yates; and U.S. Pat. No. 5,955,696 to Meller. While these devices may be suited to their specific applications, they do not provide the benefits achievable through use of the present invention.

What is generally needed is a semiautomatic firearm which enables easier or lighter cocking action than is available in current semiautomatic firearms. The lighter cocking action should permit easier loading of a first round from the magazine to the chamber, but should also permit the recoil spring to resume normal function during firing and subsequent loading of rounds from the magazine. Finally, the improved mechanisms described herein should be implemented in a manner that avoids or minimizes additional weight or volume to the resulting firearm.

SUMMARY OF THE INVENTION

A semiautomatic firearm with reduced cocking action and reduced recoil is provided, comprising a firing chamber, a barrel, a frame, a slide movable with respect to the barrel and the frame between battery and full recoil positions, means for sequentially ejecting a spent cartridge and loading a fresh cartridge during each recoil cycle, and a firing mechanism for firing the cartridge when the slide is in battery, wherein the improvement comprises an assembly for enabling only a single lighter spring to cock the pistol and/or load a first cartridge.

In a preferred embodiment, the assembly comprises a spring tube having a rear end and a front end, and including an outer surface and a pair of diametrically opposed longitudinal slots extending from the front end to the rear end, and wherein the spring tube is slidably disposed within an opening in the slide. An inner spring resides within the spring tube, wherein the inner spring includes a first spring constant. An outer spring resides around the outer surface of the spring tube, wherein the outer spring includes a second spring constant and an annular cap connected to the front end of the outer spring.

Preferably, a locking device is disposed within the front end of the inner spring, and having opposing tabs slidably engaged within the slots of the spring tube and with the opening of the slide, and wherein the opposing tabs are biased against the front end of the slots by the annular cap of the outer spring.

A spring stop is operatively connected to the rear end of the spring tube and engaged with the barrel, wherein the spring stop includes a rod residing coaxially within the inner spring.

An anti-rotation spring is operatively attached between the spring tube and the spring stop, wherein the anti-rotation spring is adapted to permit partial and biased rotation of the spring tube and the locking device relative to the spring stop between a first rotational position and a second rotational position.

The opening in the slide includes opposing recesses adapted to permit slidable passage of the opposing tabs through the opposing recesses, and to allow compression of only the outer spring, when the locking device and the spring tube are in the second rotational position for loading a first cartridge.

Also, the opposing tabs are engaged by the slide, and both the inner spring and the outer spring are allowed to compress, when the locking device and the spring tube are in the first rotational position for firing the first cartridge and subsequent cartridges.

Preferably, the spring stop includes a detent engaged with a first end of the anti-rotation spring, and wherein the spring stop includes a clamp engaged with the detent and with the spring tube.

In a preferred embodiment, the longitudinal slots are closed at the front end of the spring tube and open at the rear end of the spring tube.

The firearm further includes means for resetting the locking device from the second rotational position back to the first rotational position.

Preferably, each of the opposing recesses of the opening in the slide include a ramp slidably engageable with one of the opposing tabs of the locking device; and a locking surface adjacent to the ramp adapted to receive and lock the opposing tab in the first rotational position.

Also more preferably, the slide includes an unlocking device adapted to move the opposing tabs of the locking device from the locked first rotational position to the second rotational position.

More preferably, the unlocking device includes a grip member slidably disposed along the slide; a connecting member extending from the grip member, wherein the connecting member includes a plunger ramp; and a plunger slidably disposed within a plunger slot on the slide, wherein the plunger is operatively engaged between the plunger ramp and one of the opposing tabs of the locking device.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
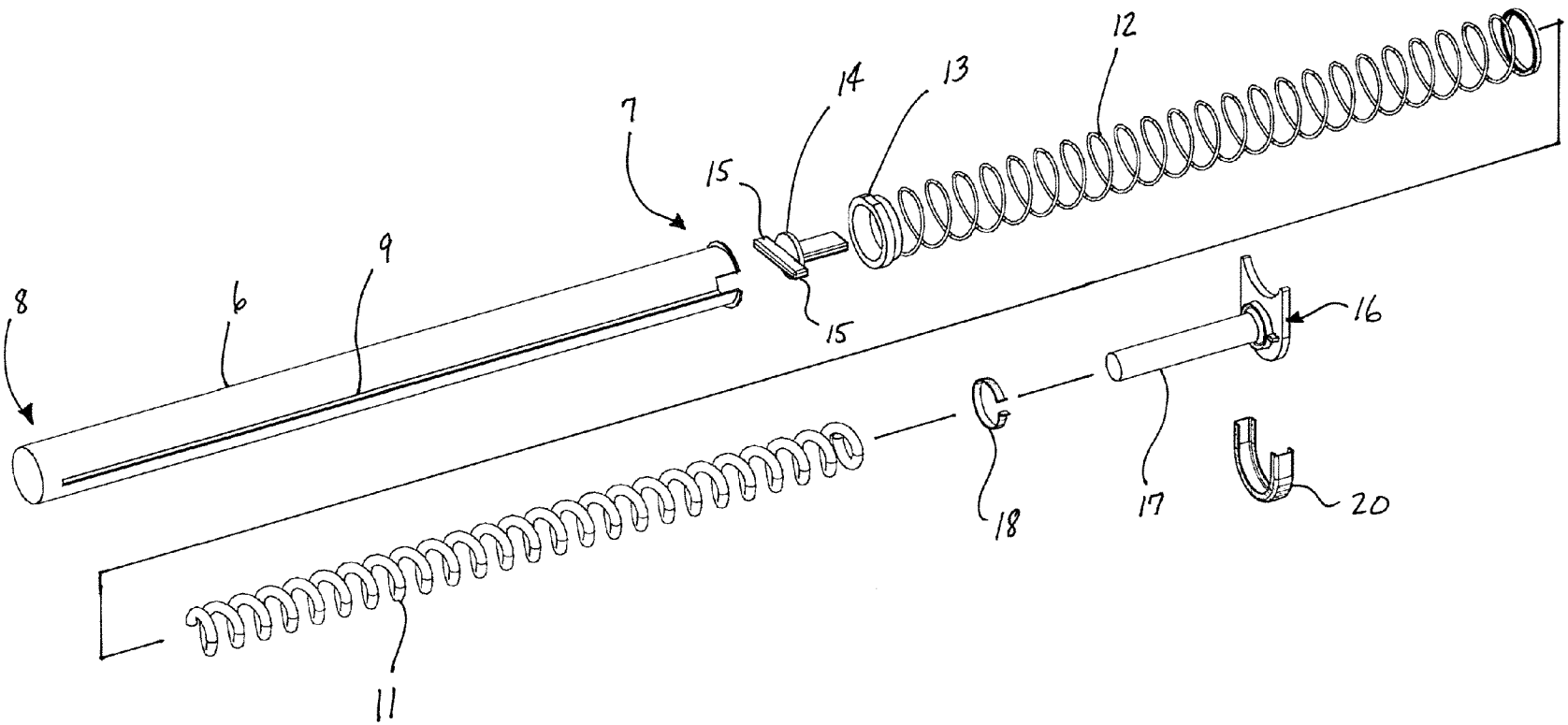
FIG. 1 shows an exploded perspective view of selected components in accordance with one embodiment of the present invention.
Figure 2:
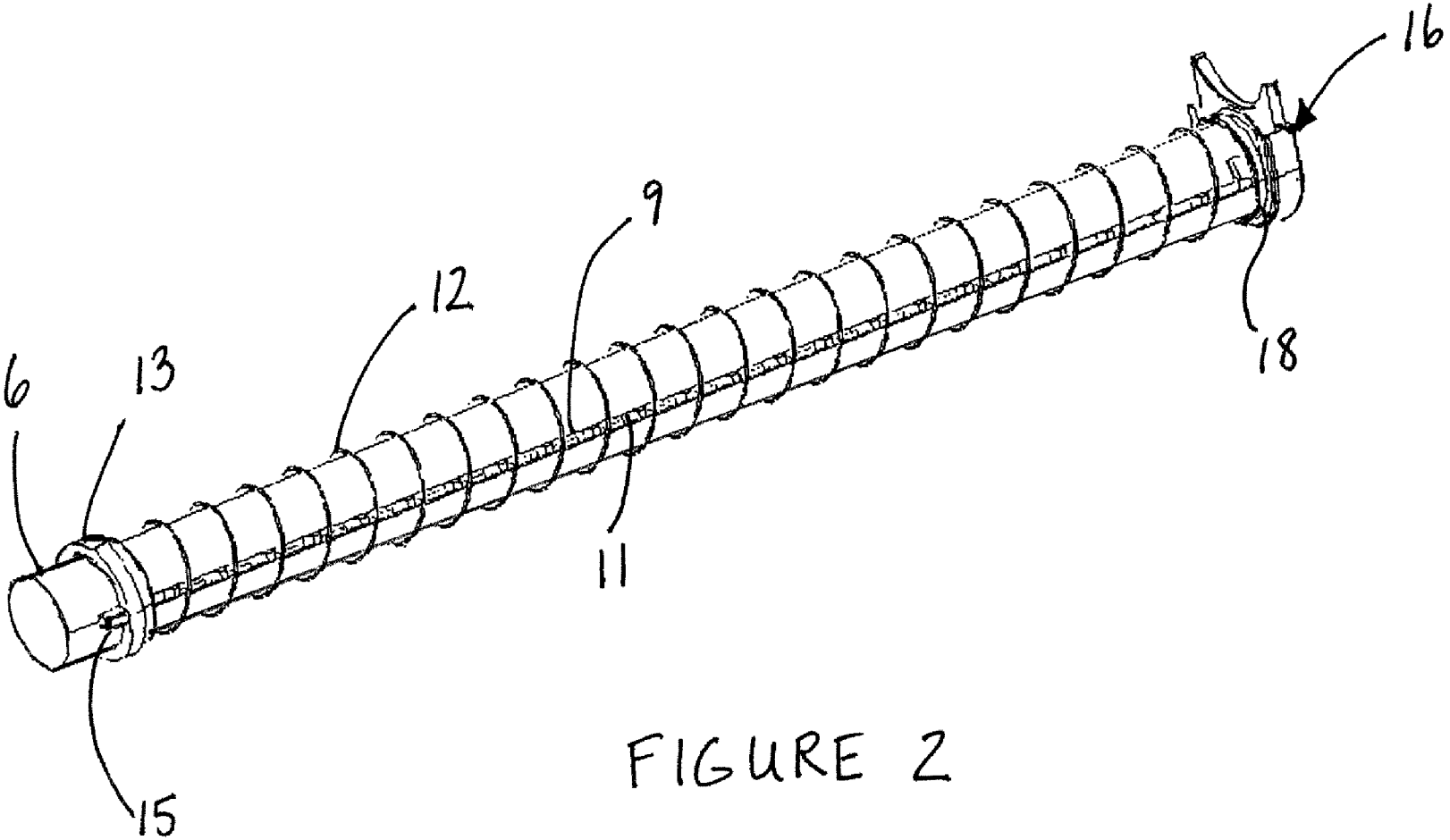
FIG. 2 shows an assembled view of the embodiment of FIG. 1.
Figure 3:
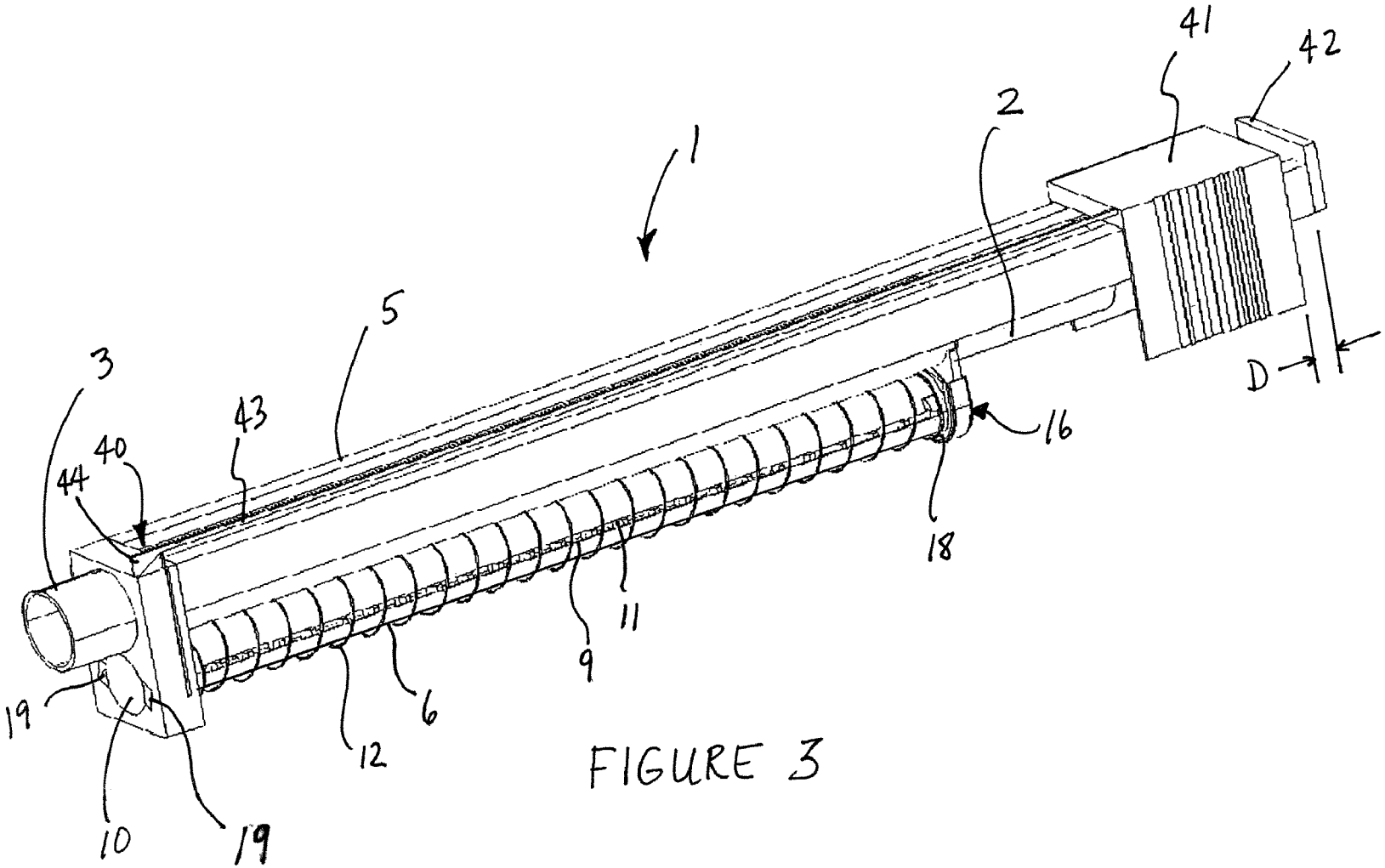
FIG. 3 shows an assembly view of the invention in combination with the barrel and slide of a semiautomatic firearm with the assembly in a pre-cocked configuration.
Figure 4:
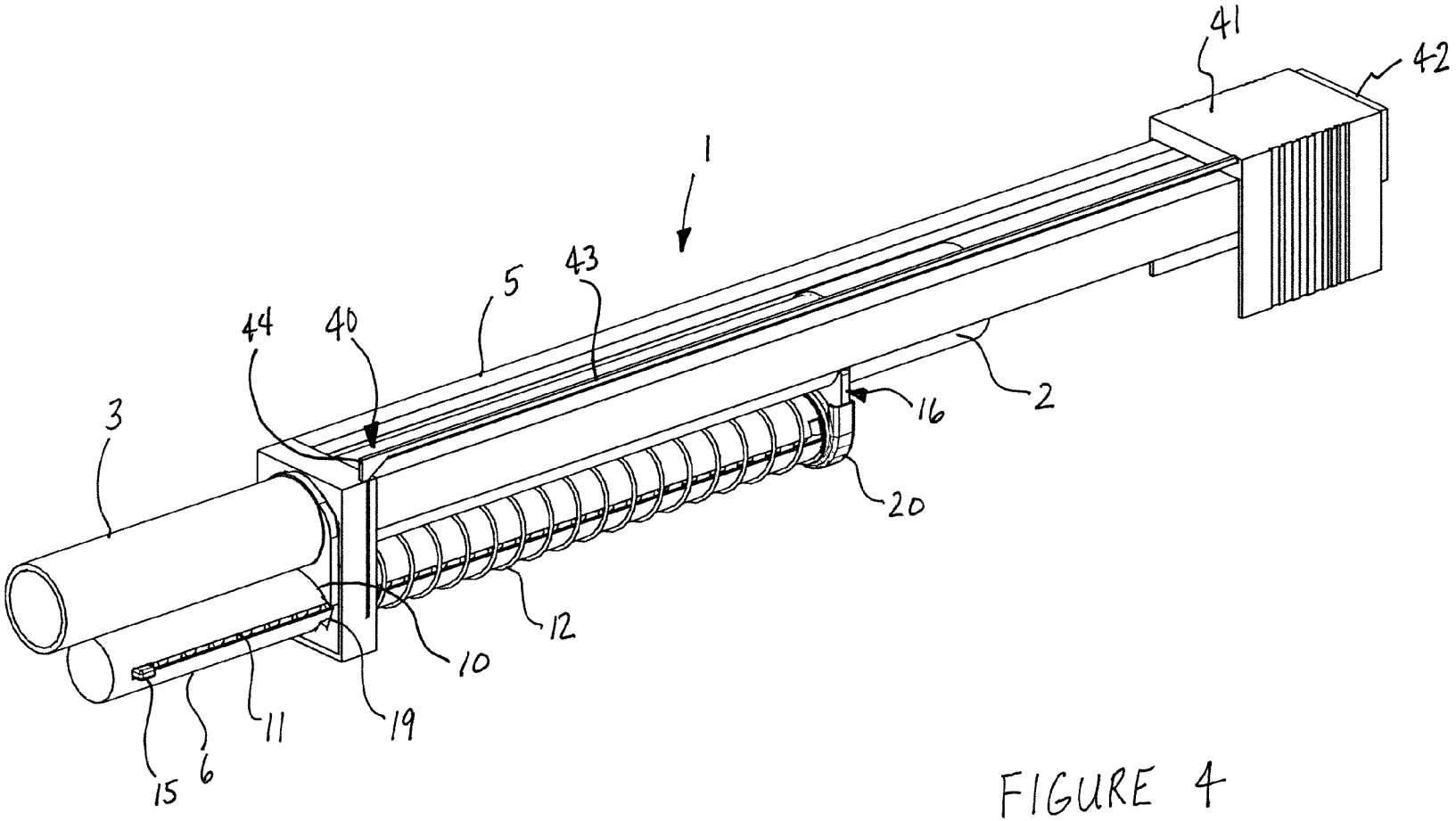
FIG. 4 shows an assembly view of the invention during a cocking action and loading of a first cartridge, wherein only the outer spring is compressed, because the locking device and spring tube are in a first rotational position.
Figure 5:
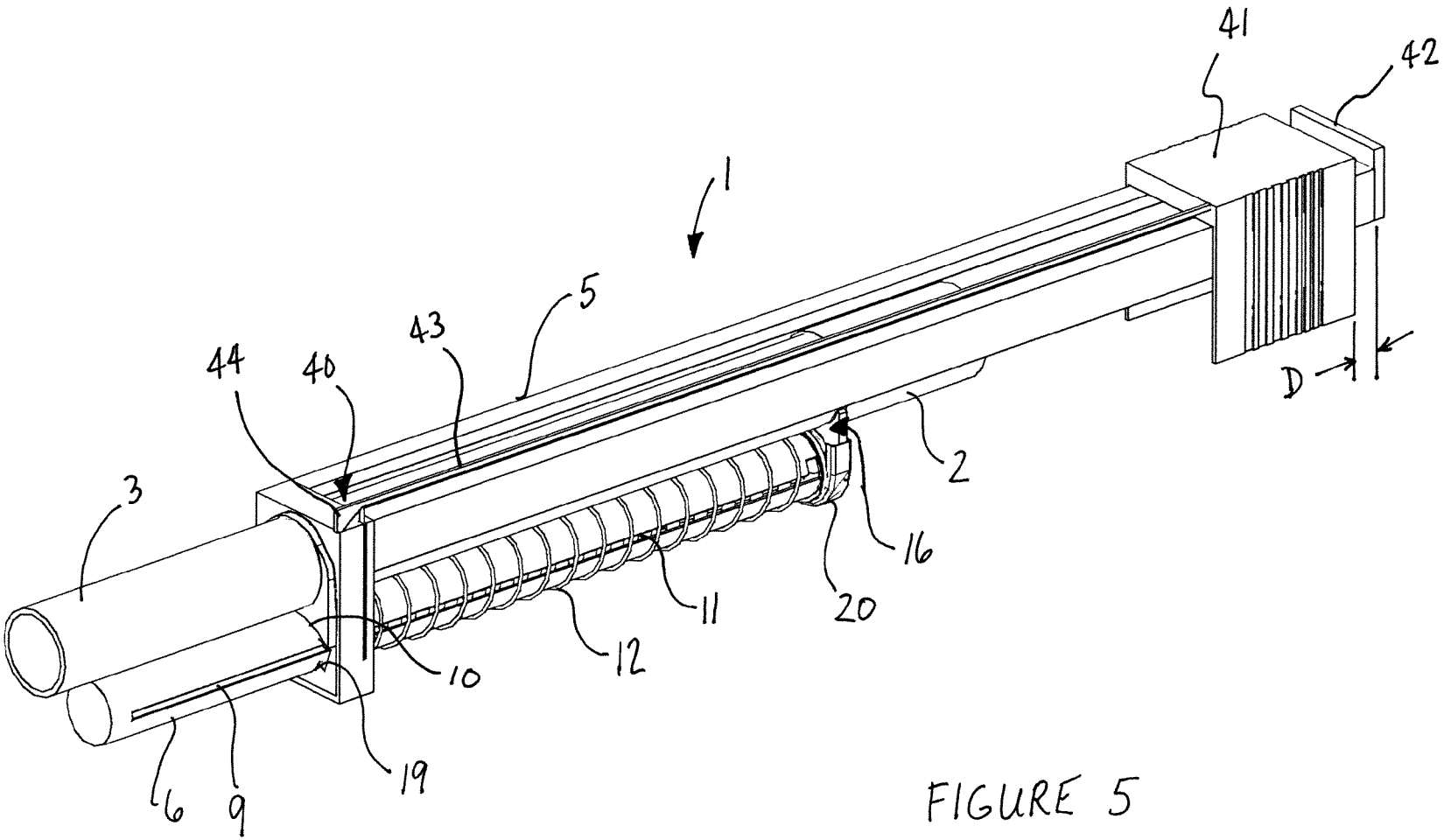
FIG. 5 shows an assembly view of the invention during the firing of subsequent cartridges, wherein both the outer spring and the inner spring are compressed, because the locking device and the spring tube are in a second rotational position.

Turning now to FIGS. 1 and 2, the invention relates to improvements to a semiautomatic firearm 1 to provide reduced cocking effort and easier loading of a first cartridge (or "round"), as well as reduced felt recoil. All semiautomatic pistols 1 include a firing chamber 2, a barrel 3, a frame, a slide 5 movable with respect to the barrel 3 and the frame between battery and full recoil positions, means for sequentially ejecting a spent cartridge and loading a fresh cartridge during each recoil cycle, and a firing mechanism for firing the cartridge when the slide 5 is in battery. FIGS. 3-5 are shown with a partially assembled view of the firearm to illustrate the internal components described herein. It should be appreciated that the grip and frame of the firearm should remain essentially unchanged from a conventional semiautomatic pistol, except for differences specific to designs from various manufacturers.

With reference to the exploded view of FIG. 1, in a preferred embodiment, the improved firearm 1 comprises a spring tube 6 having a rear end 7 and a front end 8, and including an outer surface and a pair of diametrically opposed longitudinal slots 9 extending from the front end 8 to the rear end 7, and wherein the spring tube 6 is slidably disposed within an opening 10 in the slide 5 (best shown in FIGS. 4 and 5).

An inner spring 11 resides within the spring tube 6, wherein the inner spring 11 includes a first spring constant. In a more preferred embodiment, the inner spring 11 is the main recoil spring, although such arrangement is not necessarily required by the present invention.

An outer spring 12 resides around the outer surface of the spring tube 6, wherein the outer spring 12 includes a second spring constant. As mentioned above, the inner spring 11 may often be the main recoil spring. If that is the case, then the second spring constant of the outer spring 12 would be less than the first spring constant of the inner spring 11. In other words, the outer spring 12 would be much lighter, or easier to compress, than the inner spring 11. The outer spring 12 includes an annular cap 13 connected to the front end of the outer spring 12.

A locking device 14 is disposed within the front end of the inner spring 11 (best shown in FIGS. 2 and 4), and includes opposing tabs 15 slidably engaged within the slots 9 of the spring tube 6 when fully assembled. The opposing tabs 15 are biased against the front end of the slots 9 by inner spring 11, because the inner spring 11 should be slightly compressed during assembly.

A spring stop assembly 16 is operatively connected to the rear end of the spring tube 6 and engaged with the barrel 3, wherein the spring stop assembly 16 includes a base member 21 having a curved portion 22 to engage the barrel 3, and a rod 17 residing coaxially within the inner spring 11. The spring stop assembly 16 is shown best in FIGS. 5A-5C, which figures illustrate the sequential addition of other components for clarity, as will be further explained below. The base member 21 further includes an annular concave surface 23 that provides a seat for the inner spring 11 and ensures concentricity between the inner spring 11 and rod 17. The base member 21 also includes an anti-rotation spring mounting surface 24 that is coaxial with rod 17.

Figure 5A:
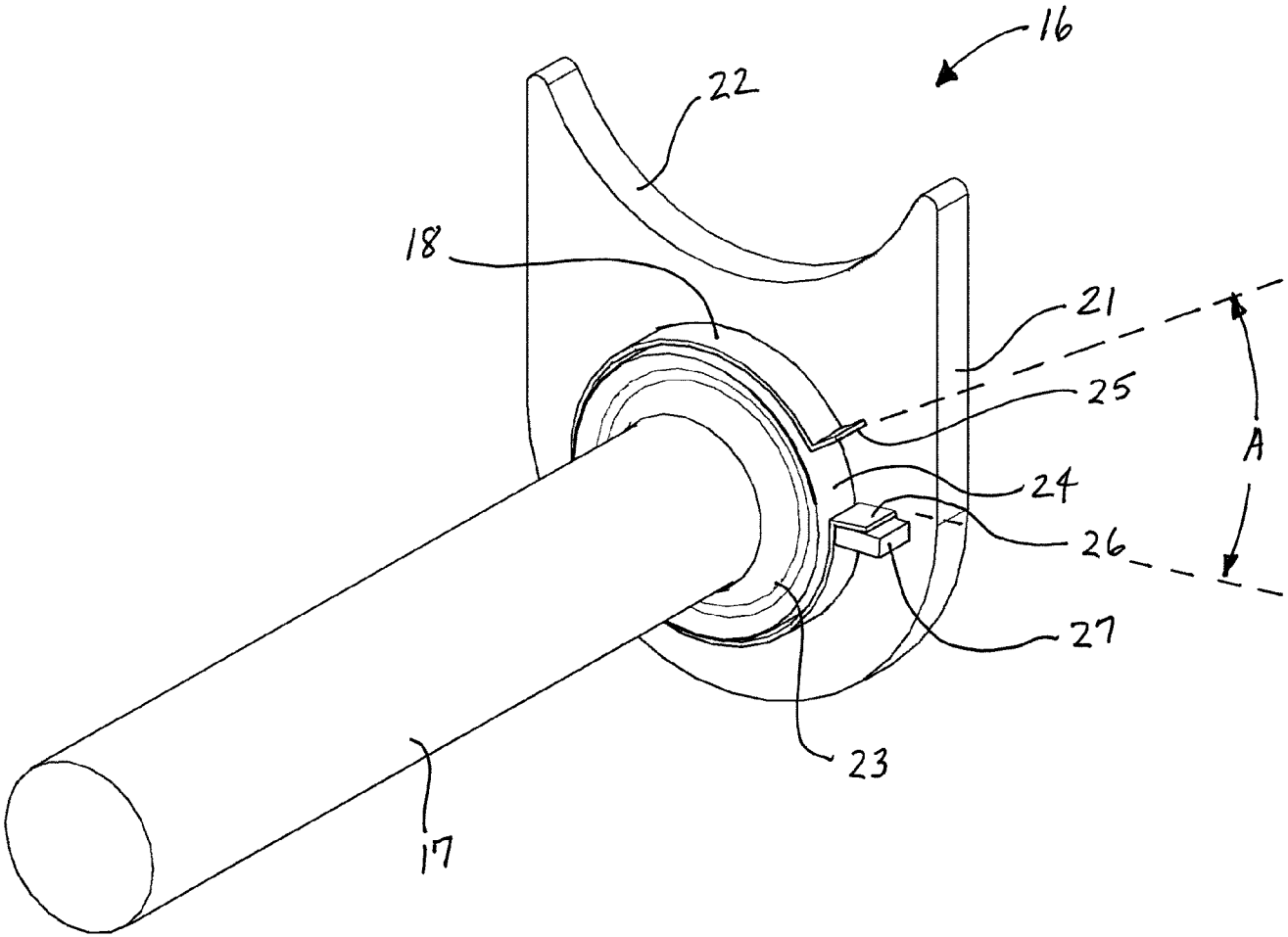
FIGS. 5A-5C show detailed views of invention at different stages of the assembly.

With further reference to FIG. 5A, an anti-rotation spring 18 roughly in the shape of a partial or open band is operatively attached around the surface 24. The anti-rotation spring 18 includes a first flange 25 and a second flange 26. When the anti-rotation spring 18 is installed, the second flange 26 rests partially on a boss 27 protruding from the face of the base member 21. Thus, an angular gap A is present when the anti-rotation spring 18 is uncompressed. As will be appreciated, the inside diameter of the anti-rotation spring 18 should be slightly larger than the diameter of the surface 24 so that full compression of the spring 18 between the first and second flanges 25, 26 may be accomplished unimpeded.

Figure 5B:
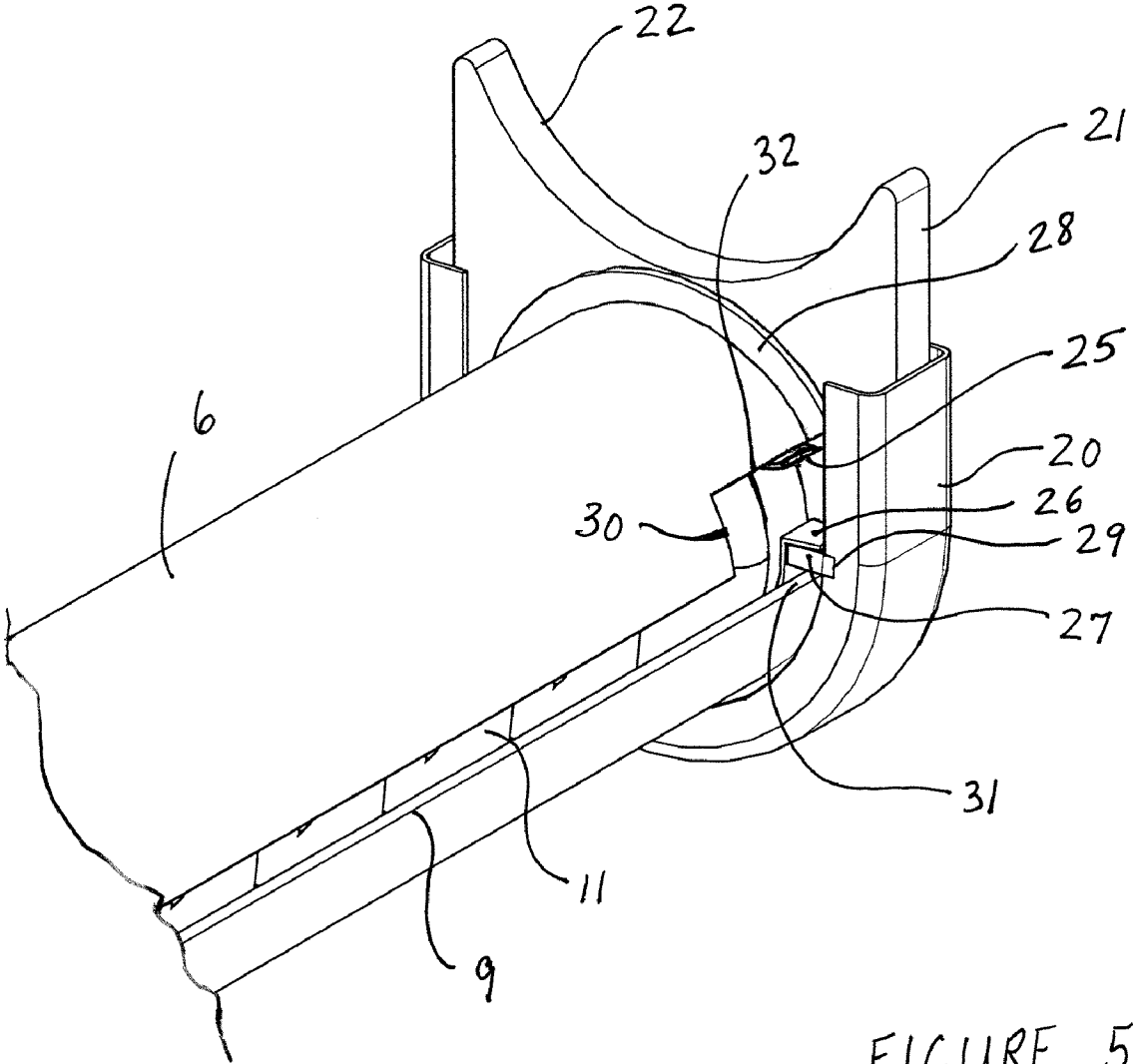

With reference to FIG. 5B, the inner spring 11 is shown inserted within the spring tube 6, and the spring tube 6 and inner spring 11 are mounted on the rod 17. As described above, the locking device 14 is also positioned on the opposite end of the inner spring 11 and is biased against the ends of slots 9, as shown in FIGS. 2 and 4. To secure the components for assembly, the spring tube 6 includes a circumferential flange 28 that rests against the face of base member 21. A U-shaped clamp 20 having a C-shaped cross section is mounted onto the base member 21 to firmly retain the spring tube 6 to the base member 21. Although the clamp 20 may be secured in various ways, the means in FIG. 5B illustrates a notch in the clamp 20 that snaps onto the boss 27. In the preferred embodiment, the spring tube 6 further includes a cutout portion 30 at the rear end of one of the slots 9. The cutout portion 30 should be sized such that the bottom edge 31 of the slot 9 fits snugly under the boss 27, and such that the upper edge 32 of the cutout portion 30 rests on the first flange 25 of the anti-rotation spring 18. When assembled, the anti-rotation spring 18 should be slightly in compression to avoid rattling and ensure a secure fit. From this arrangement, it can be understood that the anti-rotation spring 18 is compressed when the locking device 14 and the spring tube 6 are rotated relative to the base member 21 through angle A between a first rotational position (shown in FIGS. 5B and 5C) and a second rotational position. The maximum rotation is achieved when the first and second flanges 25, 26 are contacting each other.

Figure 5C:
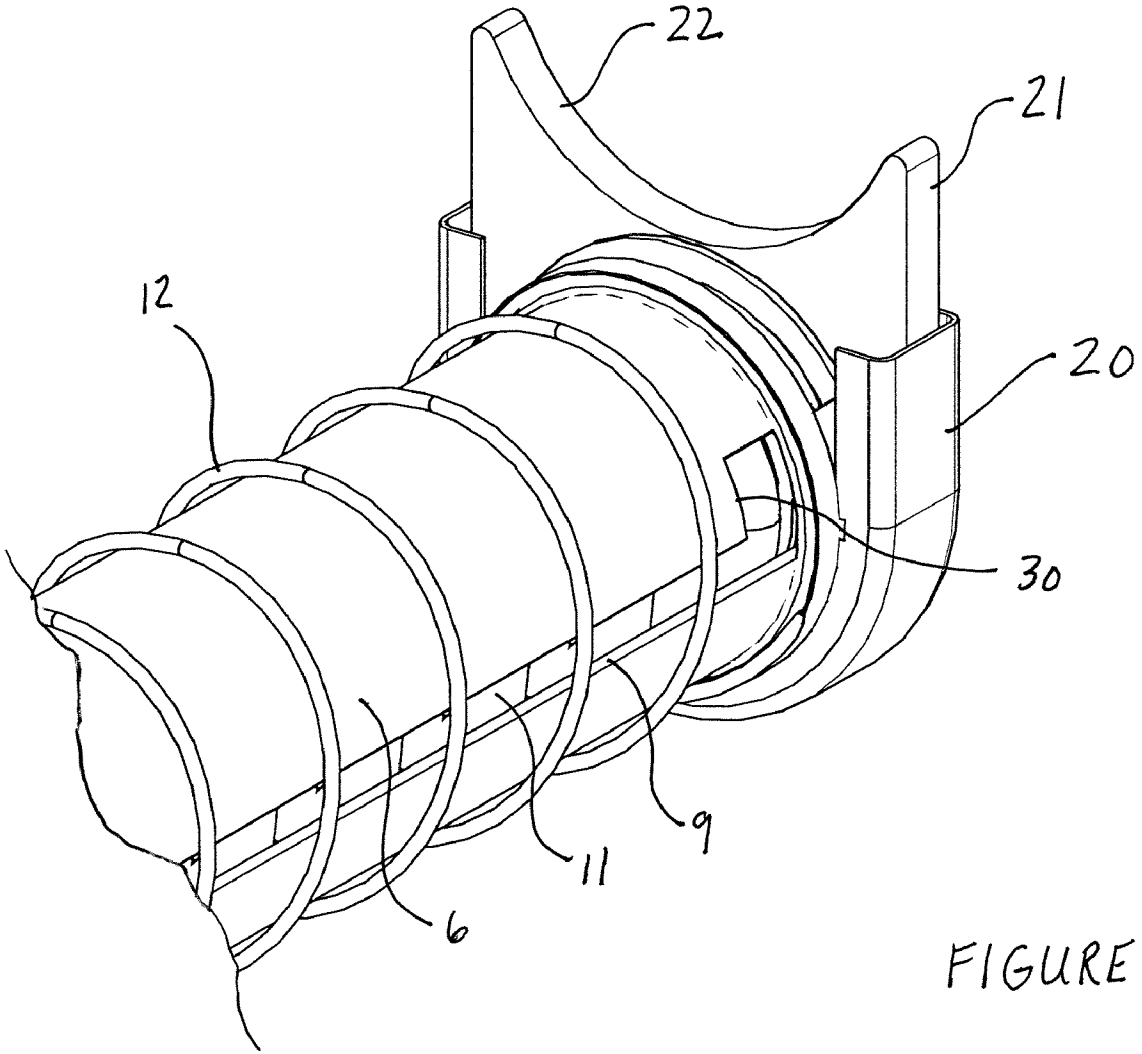

With reference to FIG. 5C, the outer spring 12 is shown added to the assembly, such that the rear end of the outer spring 12 rests against the clamp 20. The front end of the outer spring 12 and the annular cap 13 are slightly biased against the opposing tabs 15 of the locking device 14, as shown in FIG. 2.

Figure 6A:
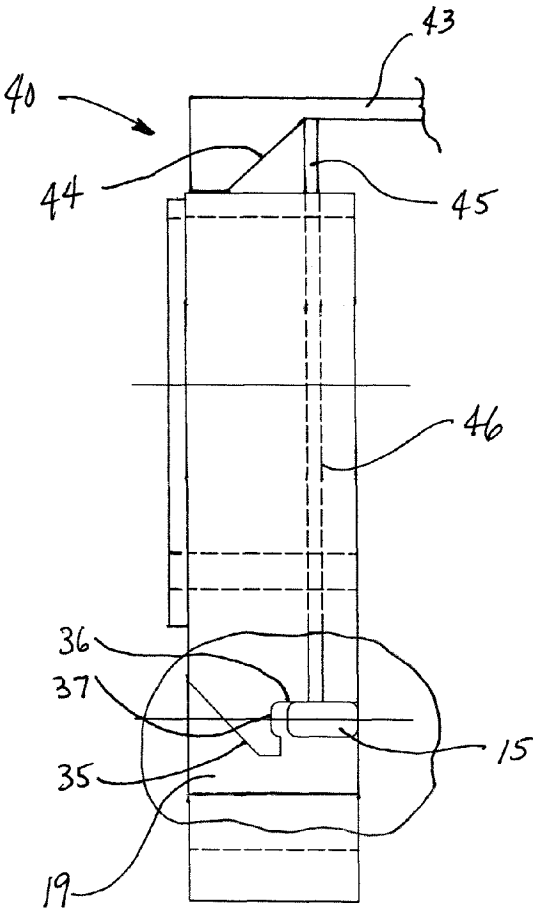
FIGS. 6A and 6B show partial sectional side views of the front of the firearm depicting the operation of the locking device and unlocking device relative to the slide.
Figure 6B:
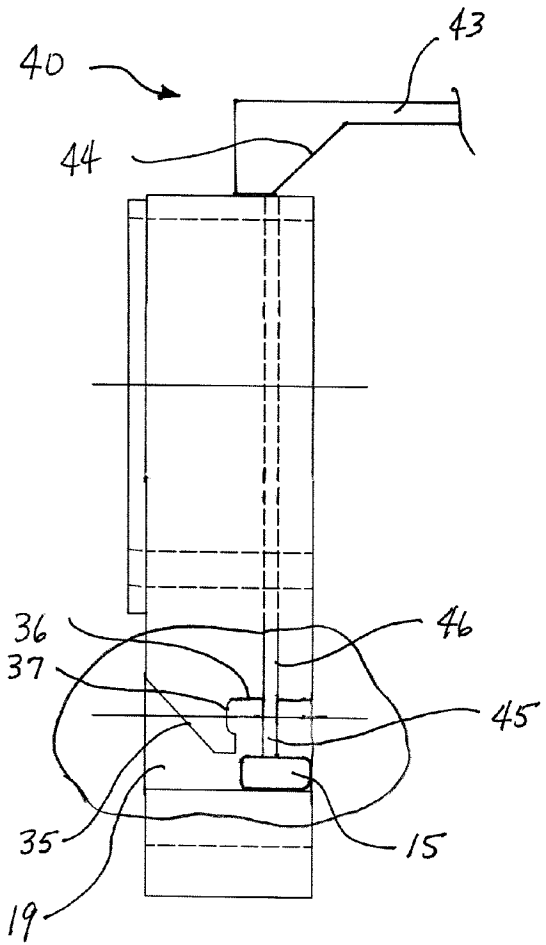
Figure 7:
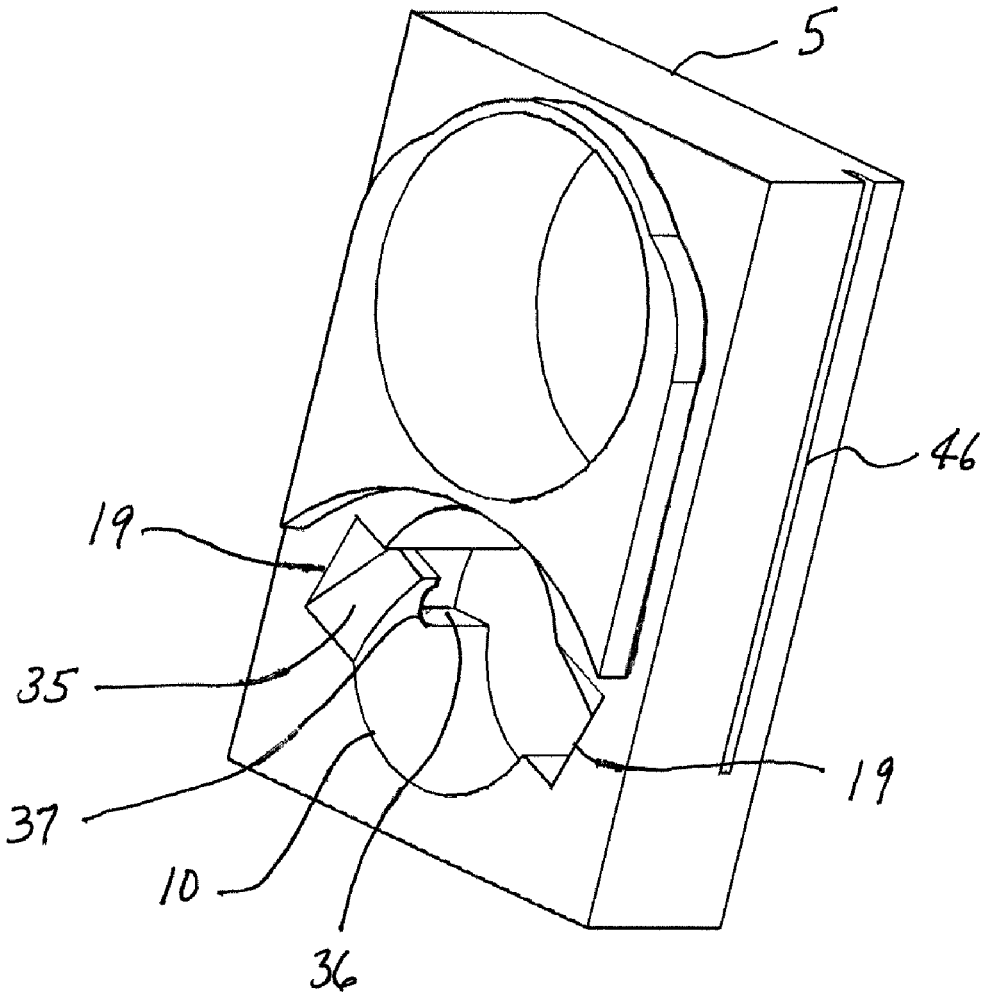
FIG. 7 shows a perspective view of one embodiment of a modified front portion of the slide used in connection with the present invention.

Referring now to FIGS. 3-5, and FIGS. 6A, 6B, and 7, in a preferred embodiment, the opening 10 in the slide 5 includes opposing recesses 19 adapted to permit slidable passage of the opposing tabs 15 through the opposing recesses 19, and to permit axial compression of only the outer spring 12, after the locking device 14 and the spring tube 6 are rotated from the first rotational position. Each of the opposing recesses 19 of the opening 10 in the slide 5 include a ramp 35 slidably engageable with one of the opposing tabs 15 of the locking device 14. Each recess 19 also includes a locking surface 36 adjacent to the ramp 35 adapted to receive and lock the opposing tab 15 in the second rotational position. More preferably, the locking surface 36 has an adjacent concave surface 37, such that when the opposing tab 15 is seated on the locking surface 36, inadvertent dislodgement of the opposing tab 15 from the first rotational position is avoided. As can be appreciated, the internal features of the opposing recesses 19 just described for the left-most recess 19 of FIG. 7 are inverted for the right-most recess 19. Specifically, when the opposing tabs 15 are urged against the ramps 35, the locking device 14 and the spring tube 6 are caused to rotate clockwise (from the view in FIG. 7). Thus, when the locking device 14 is fully seated in the first rotational position on locking surfaces 36, pulling back the slide 5 will cause both inner spring 11 and outer spring 12 to be compressed. Such configuration represents the arrangement desired for normal firing and cycling of the firearm, because the inner spring 11 (typically the main recoil spring) is employed.

However, when the user desires to manually load a new cartridge into the firearm, the locking device 14 needs to be disengaged from the slide 5 so that only the outer spring 12 is employed. To accomplish this function, the slide 5 includes an unlocking device 40 adapted to move the opposing tabs 15 of the locking device 14 from the locked first rotational position to a second rotational position.

In a preferred embodiment, and with reference to FIGS. 3-5, 6A, 6B, and 7, the unlocking device 40 includes a grip member slidably disposed along the slide 5, such as on a slidable rail. The grip member 41 moves relative to the slide 5 through a short distance D when pulled back, until it reaches a stop member 42 on the slide 5. A connecting member 43 extends from the grip member 41 toward the front of the slide 5, wherein the connecting member 43 includes a plunger ramp 44 with an inclined surface positioned above the locking device 14. A plunger rod 45 is slidably disposed within a plunger slot 46 on the slide 5, such that the upper end of the plunger rod 45 is in slidable contact with the plunger ramp 44, and such that the lower end of the plunger rod 45 is immediately above the opposing tab 15 of the locking device 14. The plunger rod 45 and plunger slot 46 may include means to spring-load the plunger rod 45 or otherwise limit its slidable range within the plunger slot 46 so as not to interfere with the return of the opposing tabs 15 when the slide 5 is closed.

Thus, starting from the position shown in FIG. 6A, when the grip member 41 is pulled back, the plunger ramp 44 causes the plunger rod 45 to move downward within the plunger slot 46 in proportion to the distance D against the resistance of the opposing tab 15 of the locking device 14. At the maximum position of the grip member 41, the plunger rod 45 has rotated the opposing tabs 15 away from their respective locking surfaces 36. Such action takes place against the resistance of the anti-rotation spring 18 described above. Further pulling of the grip member 41 will cause the entire slide 5 to move backward, while the opposing tabs 15 pass through their respective recesses 19. After the opposing tabs pass through the recesses 19, the locking device 14 and spring tube 6 resume their normal horizontal position by the expansion of the anti-rotation spring 18. Concurrently, the slide 5 can be fully retracted against the force of the outer spring 12 alone until the trigger mechanism is cocked and the slide 5 reaches it maximum travel.

After the slide 5 is fully retracted against the outer spring 12 only, it can be released to strip a cartridge from the magazine and place the cartridge into the firing chamber 2. Return of the slide 5 toward its closed position then causes the opposing tabs 15 of the locking device 14 to contact the ramps 35 within the recesses 19. Prior to the slide 5 reaching its full forward position, the opposing tabs 15 slide along the ramps 35 against the force of the anti-rotation spring 18 until they snap back onto the locking surfaces 36. Simultaneously with this action, the plunger ramp 44 and plunger rod 45 are returned to their original positions shown in FIG. 6B.

Now that the firearm has been manually loaded, it can be fired in the normal manner. When the cartridge is fired, the slide 5 now moves backward with the opposing tabs 15 of the locking device 14 locked in the first rotational position. Therefore, cycling of the action and subsequent stripping of the cartridges from the magazine occur against the resistance of both the inner spring 11 and the outer spring 12. Advantageously, this condition also helps to reduce felt recoil during firing.

The unlocking device assembly 40, and particularly the connecting member 43, plunger ramp 44, and plunger 45 are preferably enclosed within a cover on the slide 5 so that such components are fully protected. Also, with respect to the choice of springs and spring constants for the inner spring 1 and the outer spring 12, persons of ordinary skill in the art of firearms design will appreciate that specific spring selection will vary, taking into consideration the dynamics of the particular firearm, ammunition type, and other factors.

Notably, the spring constant for the outer spring 12 only needs to be sufficient to prevent inadvertent or undesired movement of the slide 5 relative to the frame during handling of the firearm Likewise, the spring constant of the outer spring 12 should not be too strong as to adversely affect the dynamics of the recoil and loading action of the firearm.

It should be emphasized that the invention is not limited to pistols, but may also be applied with suitable modification to rifles, shotguns, and similar semiautomatic firearms where it may be desirable to reduce the effort required to cock the firearm and/or load a first cartridge. The invention can also be implemented in a manner that does not appreciably increase the weight or size of the firearm.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. In a semiautomatic firearm having a firing chamber, a barrel, a frame, a slide movable with respect to the barrel and the frame between battery and full recoil positions, means for sequentially ejecting a spent cartridge and loading a fresh cartridge during each recoil cycle, and a firing mechanism for firing the cartridge when the slide is in battery, the improvement, comprising:

(a) a spring tube having a rear end and a front end, and including an outer surface and a pair of opposed longitudinal slots extending from the front end to the rear end, and wherein the spring tube is slidably disposed within an opening in the slide;

(b) an inner spring residing within the spring tube, wherein the inner spring includes a first spring constant;

(c) an outer spring residing around the outer surface of the spring tube, wherein the outer spring includes a second spring constant, and including an annular cap connected to the front end of the outer spring;

(d) a locking device disposed within the front end of the inner spring, and having opposing tabs slidably engaged within the slots of the spring tube and with the opening of the slide, and wherein the opposing tabs are biased against the front end of the slots by the annular cap of the outer spring;

(e) a spring stop operatively connected to the rear end of the spring tube and engaged with the barrel, wherein the spring stop includes a rod residing coaxially within the inner spring;

(f) an anti-rotation spring operatively attached between the spring tube and the spring stop, wherein the anti-rotation spring is adapted to permit partial and biased rotation of the spring tube and the locking device relative to the spring stop between a first rotational position and a second rotational position;

(g) wherein the opening in the slide includes opposing recesses adapted to permit slidable passage of the opposing tabs through the opposing recesses, and to allow compression of only the outer spring, when the locking device and the spring tube are in the second rotational position for loading a first cartridge; and (h) wherein the opposing tabs are engaged by the slide, and both the inner spring and the outer spring are allowed to compress, when the locking device and the spring tube are in the first rotational position for firing the first cartridge and subsequent cartridges.

2. The firearm of claim 1, wherein the spring stop includes a detent engaged with a first end of the anti-rotation spring.

3. The firearm of claim 2, wherein the spring stop includes a clamp engaged with the detent and with the spring tube.

4. The firearm of claim 1, wherein the longitudinal slots are closed at the front end of the spring tube and open at the rear end of the spring tube.

5. The firearm of claim 1, wherein the firearm includes means for resetting the locking device from the second rotational position back to the first rotational position.

6. The firearm of claim 1, wherein each of the opposing recesses of the opening in the slide include:

(a) a ramp slidably engageable with one of the opposing tabs of the locking device; and (b) a locking surface adjacent to the ramp adapted to receive and lock the opposing tab in the first rotational position.

7. The firearm of claim 1, wherein the slide includes an unlocking device adapted to move the opposing tabs of the locking device from the locked first rotational position to the second rotational position.

8. The firearm of claim 7, wherein the unlocking device includes:

(a) a grip member slidably disposed along the slide;

(b) a connecting member extending from the grip member, wherein the connecting member includes a plunger ramp; and (c) a plunger slidably disposed within a plunger slot on the slide, wherein the plunger is operatively engaged between the plunger ramp and one of the opposing tabs of the locking device.

* * * * *